US006279518B1

(12) United States Patent
Cooley, Sr.

(10) Patent No.: US 6,279,518 B1
(45) Date of Patent: Aug. 28, 2001

(54) ROTARY ENGINE HAVING A CONICAL ROTOR

(75) Inventor: Horace Donald Cooley, Sr., Bessemer, AL (US)

(73) Assignees: Johnny L. Cooley; Paula J. Cooley, both of Westover, AL (US)

( * ) Notice: Subject to any disclaimer, the term of this patent is extended or adjusted under 35 U.S.C. 154(b) by 0 days.

(21) Appl. No.: 09/519,060

(22) Filed: Mar. 3, 2000

(51) Int. Cl.[7] ..... F02B 57/00; F02B 75/26
(52) U.S. Cl. ..... 123/54.3; 123/56.2; 123/44 R
(58) Field of Search ..... 123/54.1, 54.3, 123/56.1, 56.2, 56.9, 43 R, 43 A, 43 AA, 43 B, 43 C, 44 R, 44 E, 90.16, 90.17, 90.2, 90.21

(56) References Cited

U.S. PATENT DOCUMENTS 5,529,029 * 6/1996 Rowe et al. ..... 123/54.3
5,553,574 * 9/1996 Duncalf ..... 123/197.3
5,758,609 * 6/1998 Smith ..... 123/44 R
5,765,512 * 6/1998 Fraser ..... 123/54.1
5,875,744 * 3/1999 Vallejos ..... 123/44 R
6,016,737 * 1/2000 Leijonberg ..... 92/69 R

* cited by examiner

*Primary Examiner*—Noah P. Kamen
*Assistant Examiner*—Hai Huynh
(74) *Attorney, Agent, or Firm*—Robert J. Veal; Christopher A. Holland; Burr & Forman LLP

(57) ABSTRACT

A rotary engine includes a central rotor having a frustoconical shape with an ellipsoidal groove machined into the outer surface of the rotor. The rotor is rotated by the movement of a series of pistons mounted in cylinders surrounding the rotor. A series of piston rods connected to the pistons have piston followers that engage and follow the elliptical groove on the rotor. The rotor is mounted on a main drive shaft, and a cam assembly is additionally mounted above the rotor on the main drive shaft. Each cam in the cam assembly has a lobe, and is operable to control the intake of fuel and the exhaust of burned gases within the each cylinder according to the rotation of the main drive shaft. In this design, the piston follower encounters less friction and side forces due to the frustoconical shape of the rotor. Additionally, the pistons have a positive movement within each cylinder due to the angular placement of the cylinder in conjunction with the rotor.

20 Claims, 16 Drawing Sheets

ROTARY ENGINE HAVING A CONICAL ROTOR

FIELD OF THE INVENTION

The invention pertains to the field of internal combustion engines, and, more specifically, internal combustion engines using a novel means of transferring power from conventional cylinders and pistons to a rotor with an ellipsoidal shaped power reception groove for final power transmission to the output shaft.

BACKGROUND OF THE INVENTION

A conventional internal combustion engine attains mechanical energy from the expenditure of chemical energy of fuel burned in a combustion chamber, and is well known in the art. Conventional internal combustion engines customarily have a crankshaft that is used to transmit mechanical energy from a series of pistons to a main power output shaft. Internal combustion engines also conventionally include a cylindrical combustion chamber around which several pistons are positioned. Each piston extends and retracts around the combustion chamber, which varies the volume provided in the chamber between the inner face of the piston and the closed end of the cylinder. The outer face of the piston is attached to the crankshaft by a connecting rod, and the crankshaft thereby transforms the reciprocating motion of the piston into rotary motion.

The conventional circular path circumscribing conventional crankshafts provides several problems. First, the piston and cylinder wall is worn by "piston slide slap", wherein the pistons consistently make contact with the cylinder walls due to side forces. Additionally, the geometric area of rotating mass of the conventional rotor is also the cause of significant engine vibrations.

SUMMARY OF THE INVENTION

It is an object of the present invention to provide a rotary engine having a simple rotor design for producing efficient mechanical output while reducing the piston and cylinder wear during operation.

It is a further object of the present invention to utilize a central concentrically located shaft in relationship to the power producing cylinders, with an ellipsoidal grooved conical shaped rotor to receive energy from piston type power cylinders via cam follower-type connecting rod bearing mechanisms to produce rotational power output.

It is a further object of the present invention to provide the proper combination of mechanical linkages and configuration geometry, a system of porting, valving and burning of fuel and use of combustion materials, to transfer and transmit mechanical energy through the means of an efficient, powerful, relatively simple and cost effective internal combustion engine.

The present invention uses a central rotor having a frustoconical shape with an ellipsoidal groove machined into the outer surface of the rotor. A series of cylinders are angularity positioned with respect to the rotor, and each cylinder surrounds a piston that is connected to a piston rod. Additionally, the rotor is rotated by moving pistons in cylinders as are commonly found in conventional piston type internal combustion engines. The present invention provides a novel and alternative design in a simplified version of the piston type internal combustion engine by reducing the number of parts of the main power output rotor to thereby produce a less complex internal combustion engine than is found in conventional engines. A series of cylinders having pistons connected to piston rods are included, with the piston rods additionally being attached to piston followers that follow the elliptical groove on the rotor. By following this elliptical shaped path, the assembly will produce a more efficient power curve, with better anti-knock or pre-ignition characteristics than are conventionally generated by circular path circumscribing crankshafts, as the power curve will be flatter on the top of the curve, and sharper on the bottom of the power curve (or stroke). Piston and cylinder wall wear will also be reduced by eliminating the piston "side slap" force, as is present in conventional engines, thus prolonging cylinder and piston life as compared to conventional reciprocating engine cylinder and piston designs. The pistons will additionally be positively guided in the cylinders in this invention by eliminating nearly all lateral forces on the cylinder walls, as these forces will be absorbed within the walls of the rod guide bearings, thereby producing a better cylinder and piston design. Total engine vibration will be lessened by reducing the geometric area of rotating mass of the rotor, and dynamic balancing thereof, the design and manufacturing operations on the output (or crankshaft, in the case of normal designs) shaft, which will be much simplified as compared to conventional engine designs.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
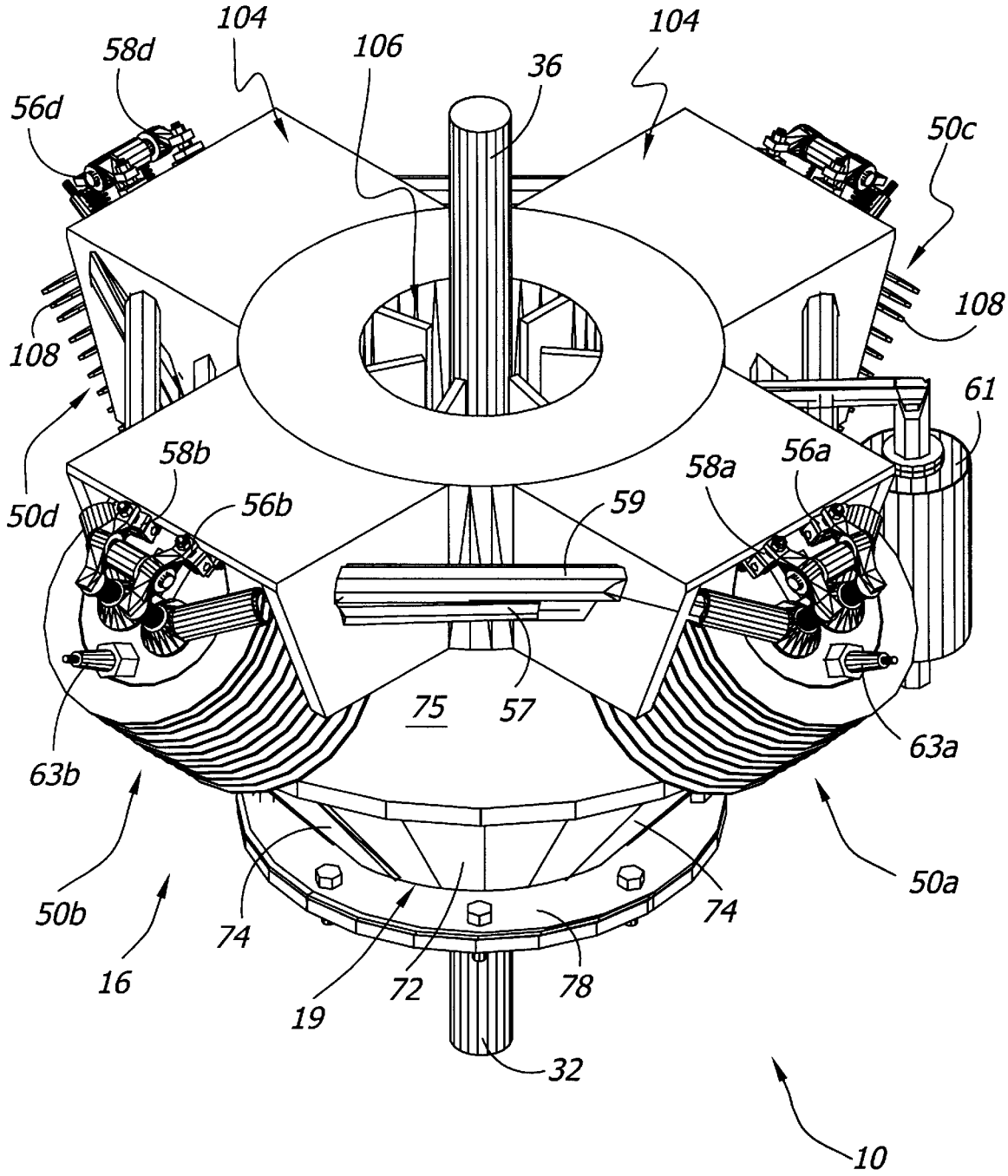
FIG. 1 is a perspective view of the disclosed embodiment of the rotary engine invention illustrating the general external appearance of the rotary engine.
Figure 1A:
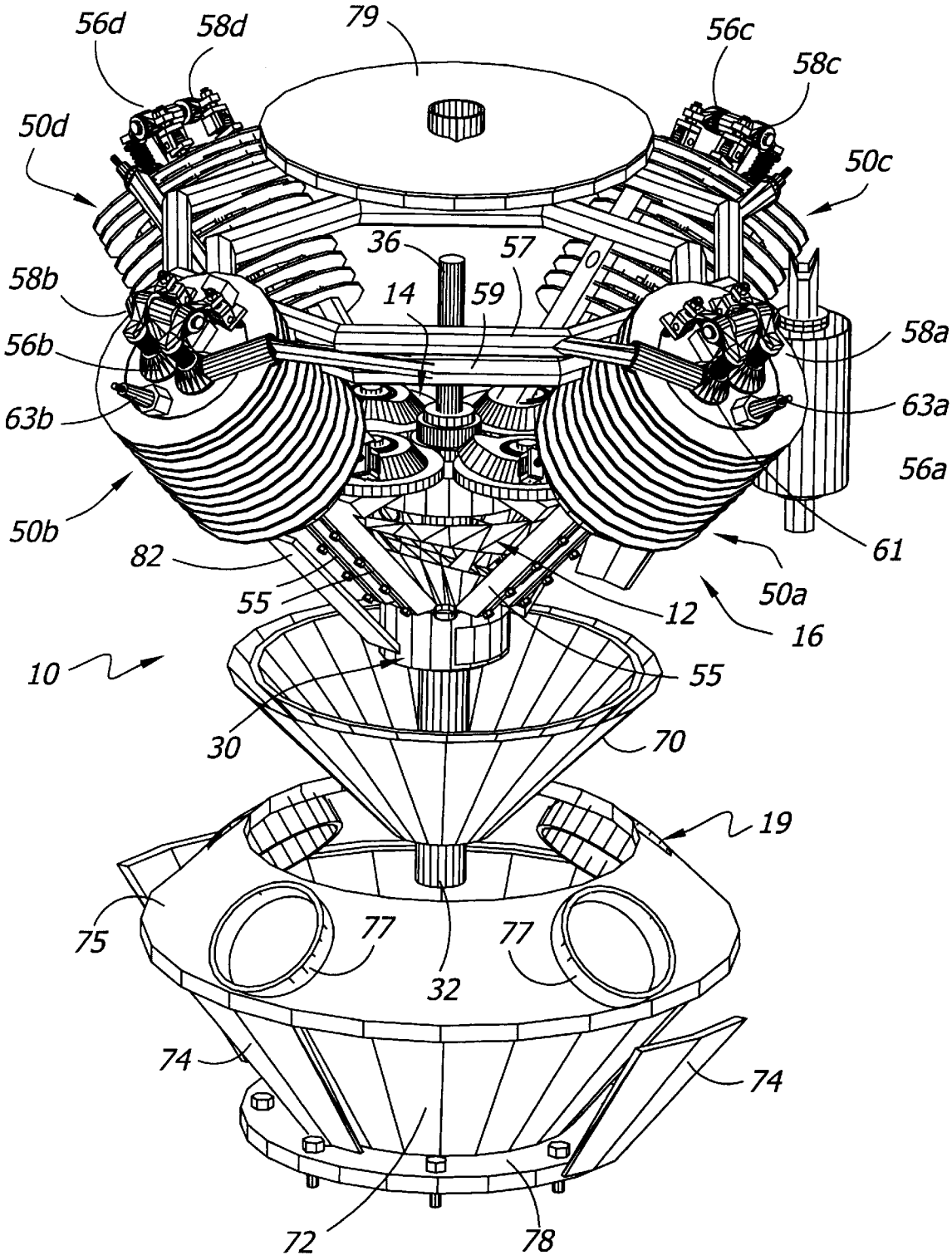
FIG. 1A is an exploded perspective view of the rotary engine as illustrated in FIG. 1, this view further illustrating the principle components thereof.
Figure 2:
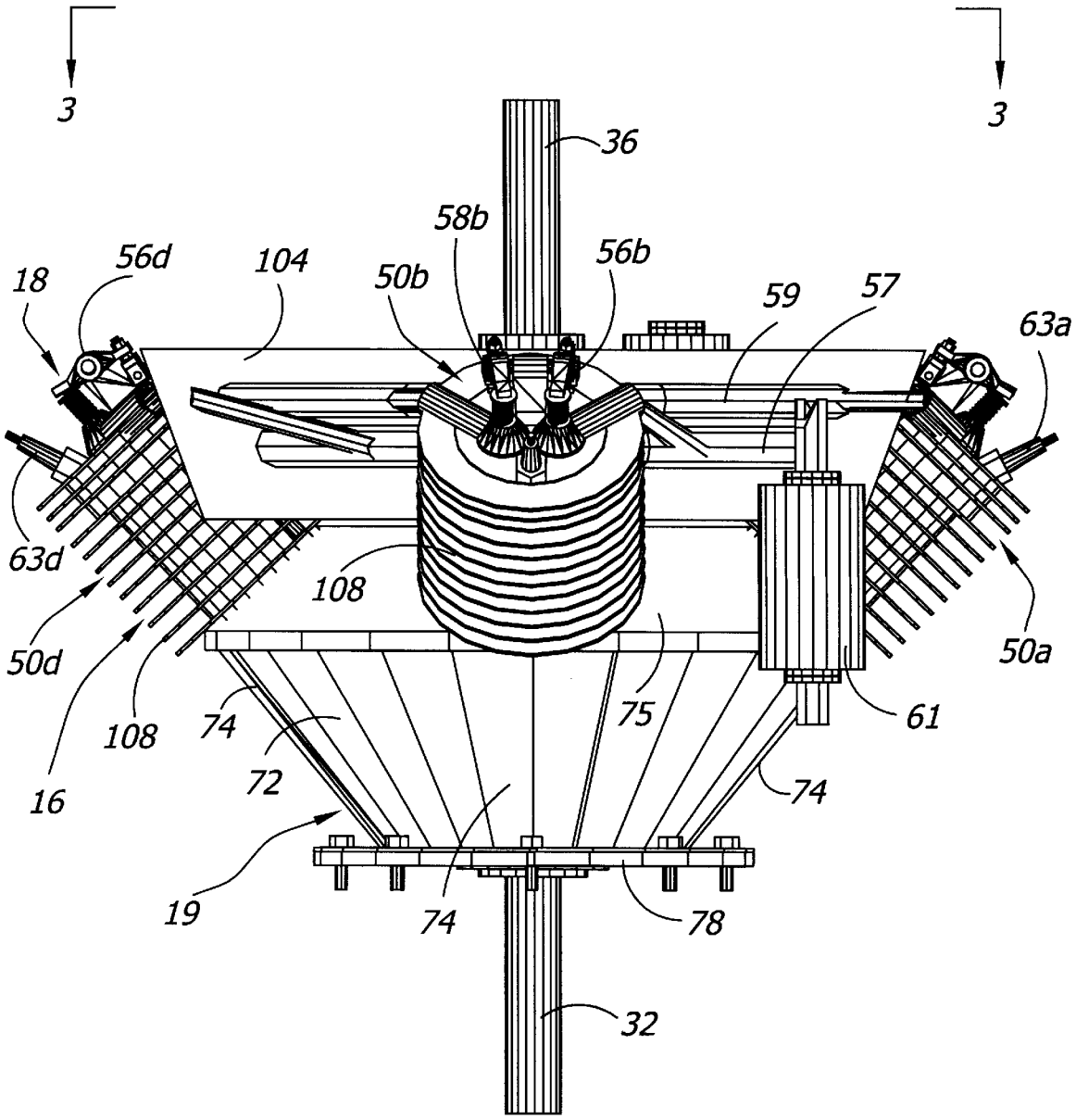
FIG. 2 is a side elevational view of the disclosed embodiment illustrating the general external appearance of the fully assembled rotary engine.

FIGS. 1 and 1A illustrate a rotary engine 10 of the present invention that may be used in internal combustion engines, among other applications. The rotary engine 10 includes the following principal elements: a rotor assembly 12, a cam assembly 14, a cylinder assembly 16, a valve assembly 18, and a housing assembly 19. The cam assembly 14 is connected to the cylinder assembly 16 via the valve assembly 18. The cylinder assembly 16 additionally engages the rotor assembly 12, and the rotor assembly 18 in turn engages the cam assembly 14. The cam assembly 14 and the rotor assembly 12 are additionally enclosed within the housing assembly 19 to obtain protection.

Figure 7:
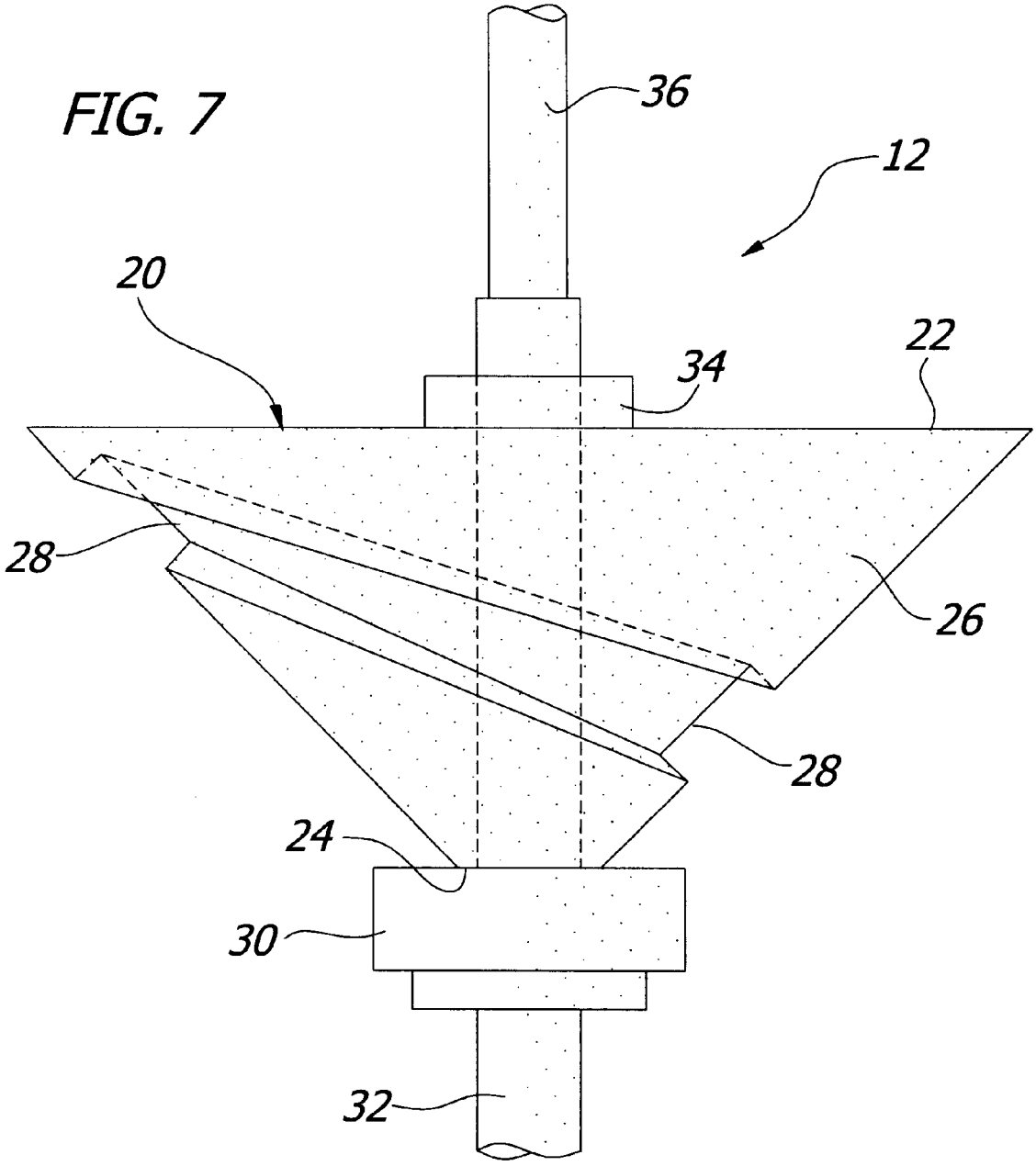
FIG. 7 is a side elevational view of the rotor, illustrating the ellipsoidal groove that is machined in the wall of the rotor.
Figure 8:
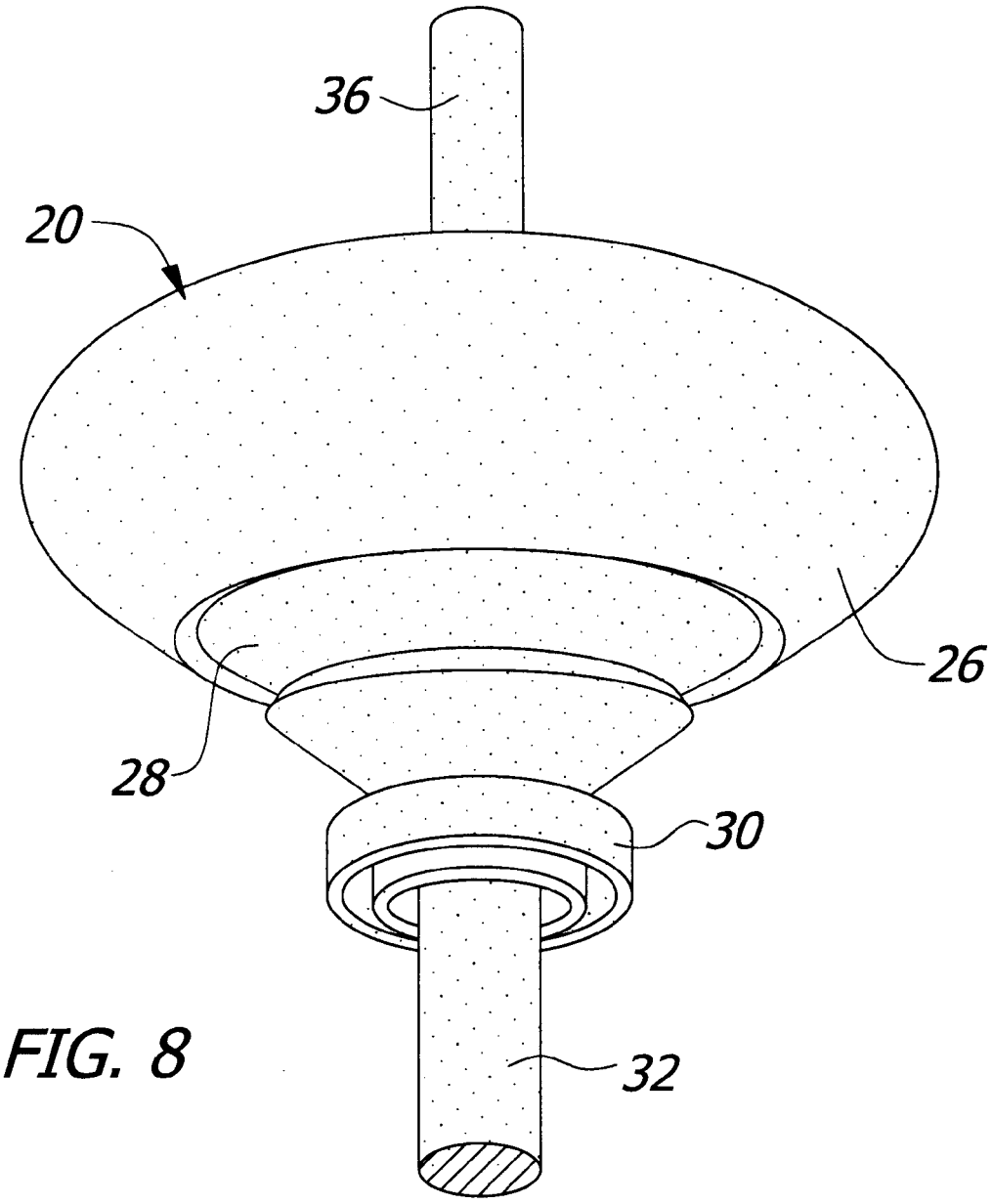
FIG. 8 is a perspective view of the rotor.
Figure 9:
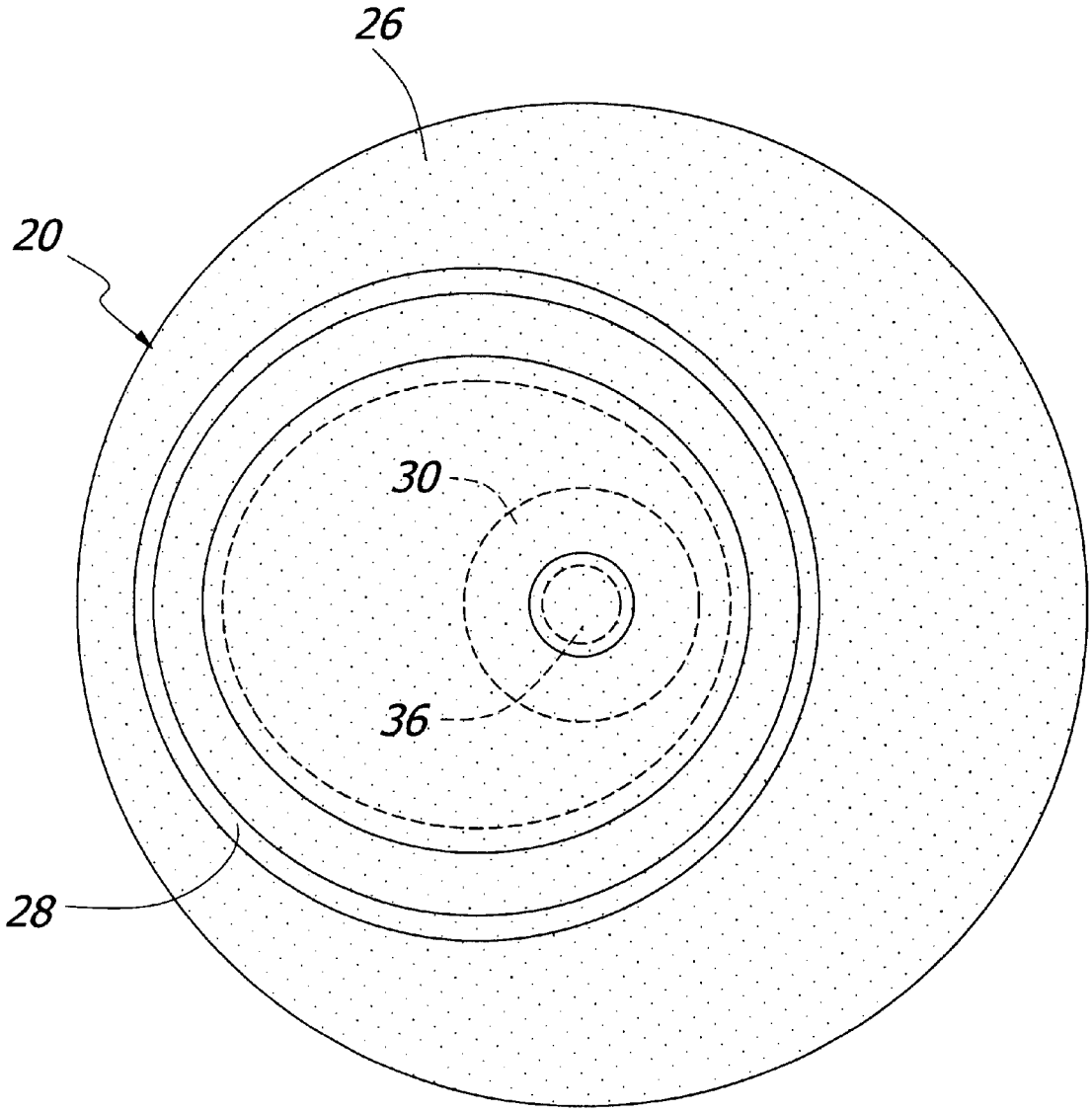
FIG. 9 is a bottom view of the rotor that is secured to the engine's main output power shaft, and illustrates the top part of the rotor.

Looking at the rotor assembly 12 in FIGS. 7, 8, and 9, the rotor assembly 12 includes a centrally located rotor 20 that is preferably conical or frustoconical in shape. The rotor 20 preferably has an upper circular surface 22 and a lower circular surface 24, with an outer surface 26 connecting the upper circular surface 22 to the lower circular surface 24. The upper circular surface 22 preferably has a greater diameter than the lower circular surface 24. An ellipsoidal groove 28 is engraved into the outer surface 26 of the rotor 20 such that the ellipsoidal groove 28 is descending around half of the rotor 20 and is ascending around the other half of the rotor 20. The path of the ellipsoidal groove 28 transcribed upon the rotor 20 is a true ellipse when viewed from the bottom of the rotor 20, as can be seen in FIG. 9. Looking at FIG. 7, the rotor 20 is illustrated as attached to a main drive shaft 32. A base bearing assembly 30 is attached to the lower circular surface 24, which uses bearings (not illustrated) between the main drive shaft 32 and the bearing assembly 30 to guide the rotation of the main drive shaft 32. An upper plate 34 is mounted to the upper circular surface 22 of the rotor 20, and the upper plate 34 is connected to an upper shaft extension 36.

Figure 4:
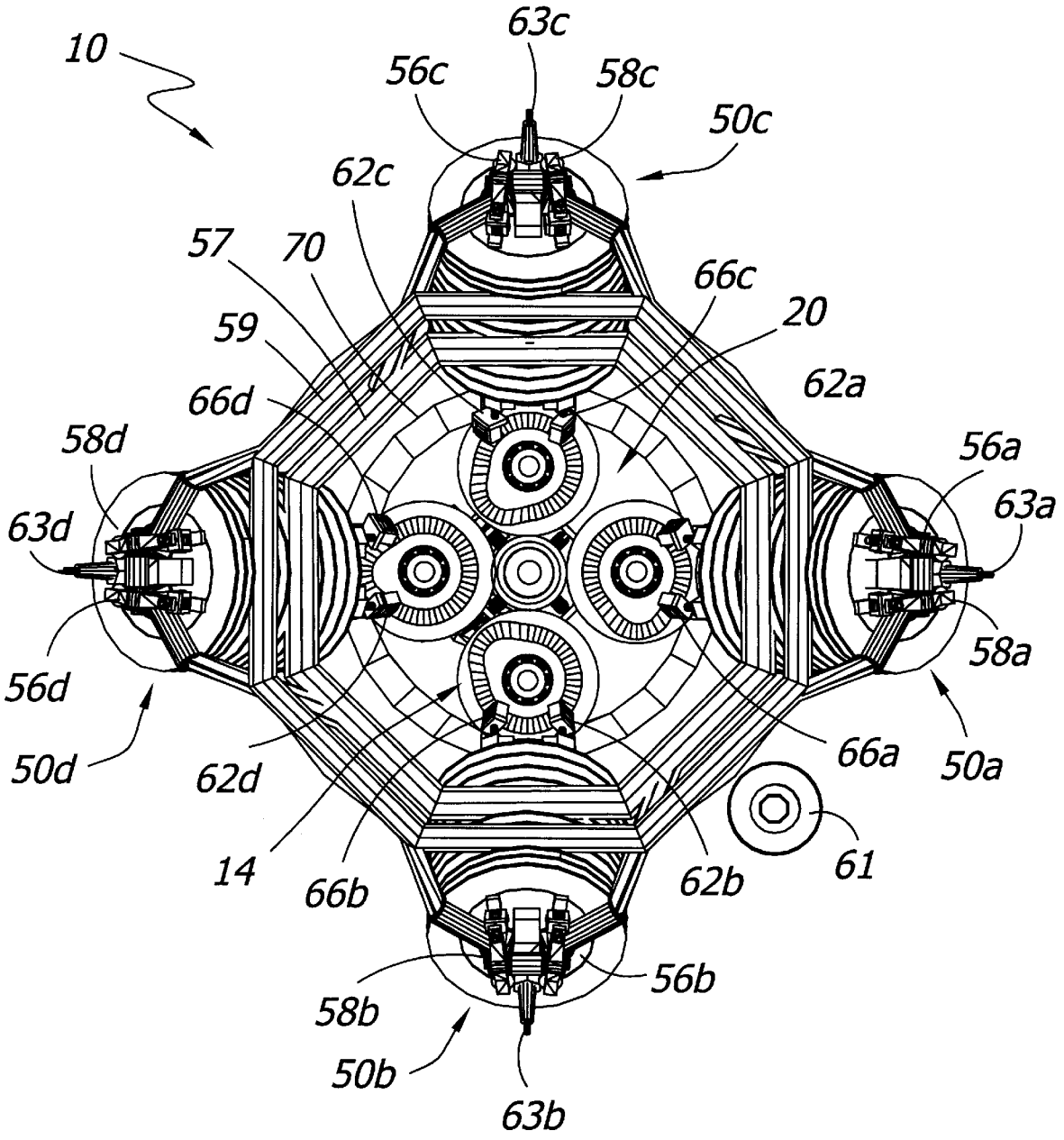
FIG. 4 is a top plan view of the rotary engine with the cooling fan and valve cam cover of the engine removed and showing the cam assembly and the cylinder assembly.
Figure 11:
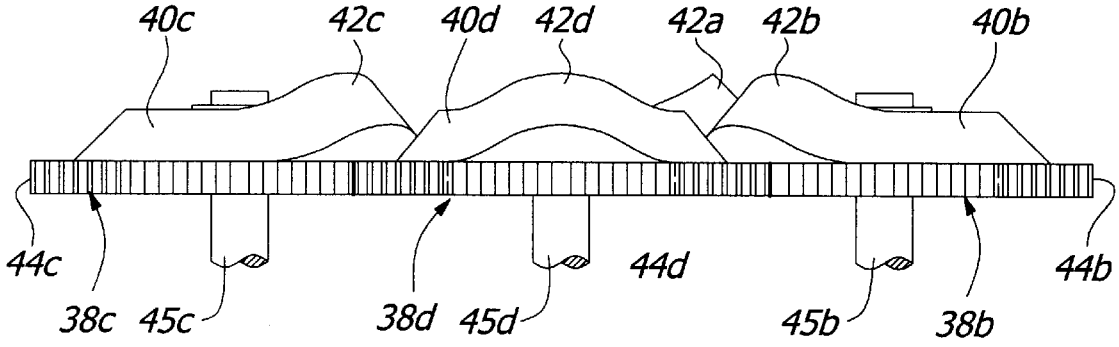
FIG. 11 is a side elevational view of the cam assembly as illustrated in FIG. 10.
Figure 12:
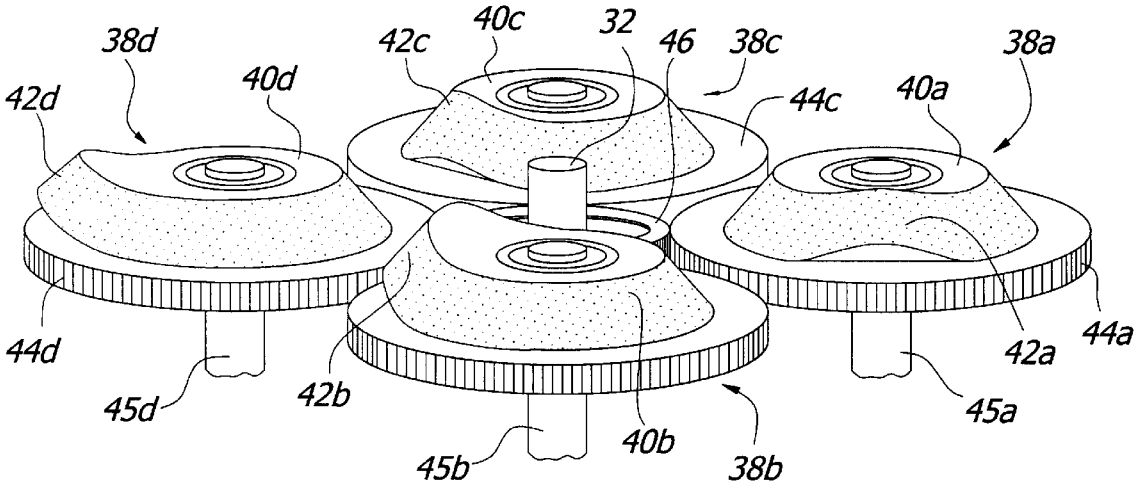
FIG. 12 is a perspective view of the cam assembly.
Figure 13:
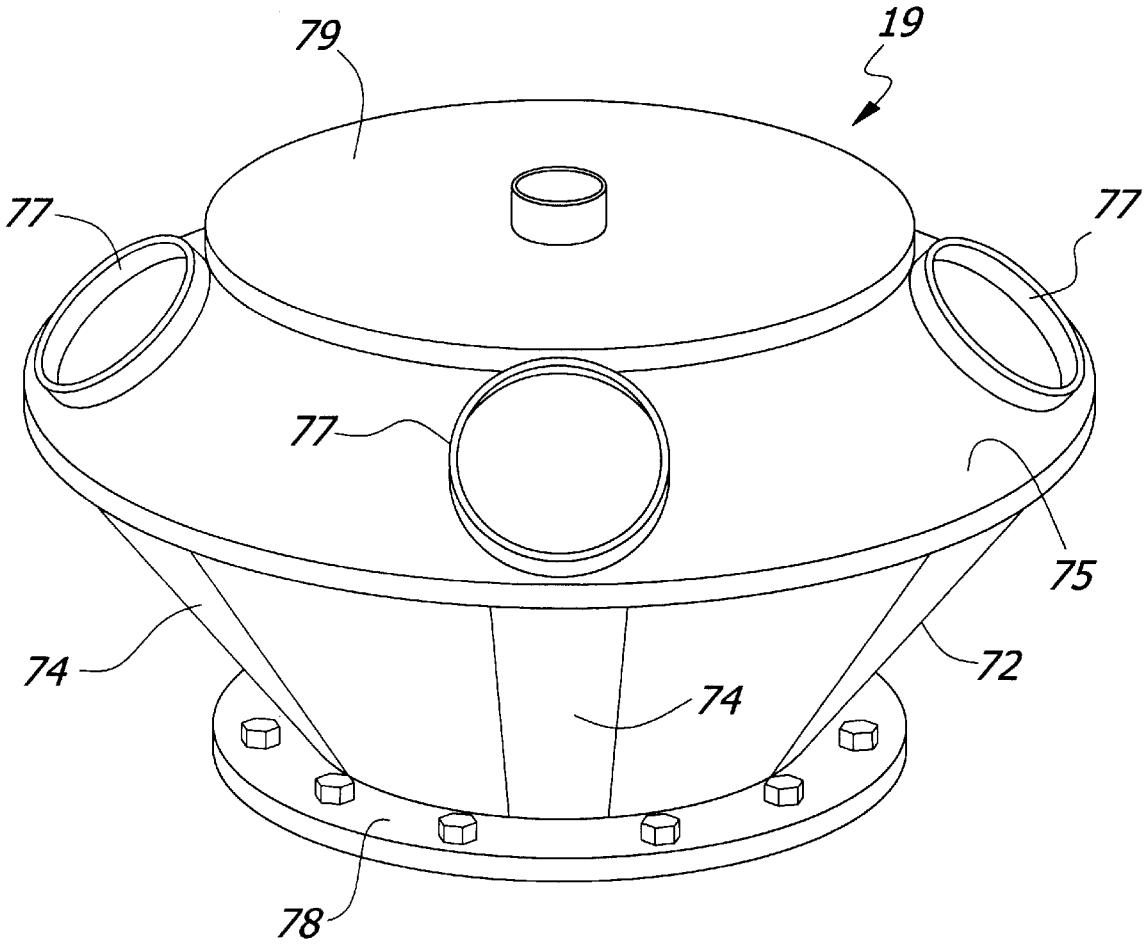
FIG. 13 is a perspective view of the combined rotor housing and the cam cover housing illustrating their general assembly including the cylinder sleeve inserts that receive the engine cylinders.
Figure 14:
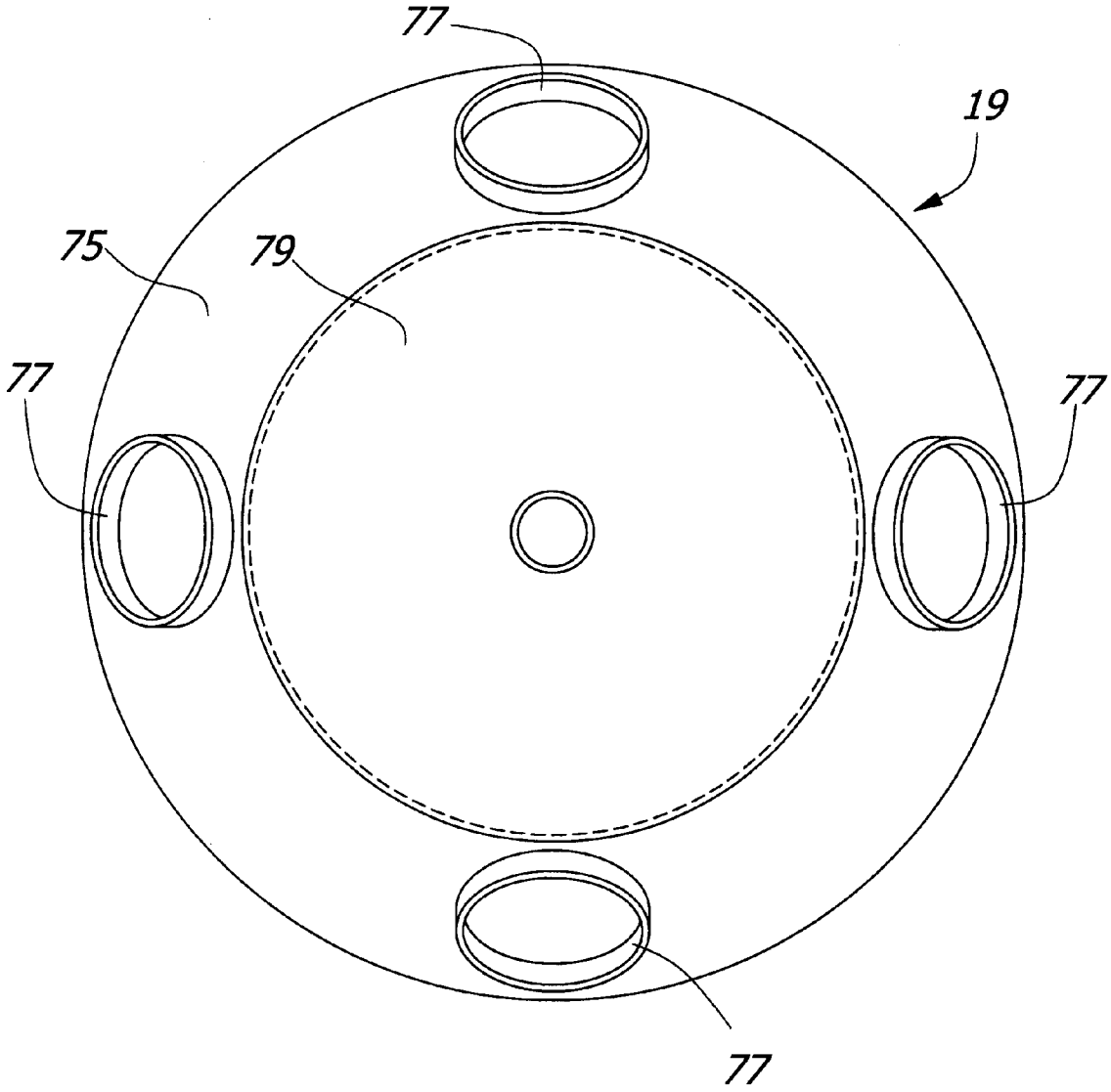
FIG. 14 is a top plan view of the combined rotor housing and the cam cover housing illustrating their individual components and general assembly including the cylinder sleeve inserts that receive the engine cylinders.
Figure 15:
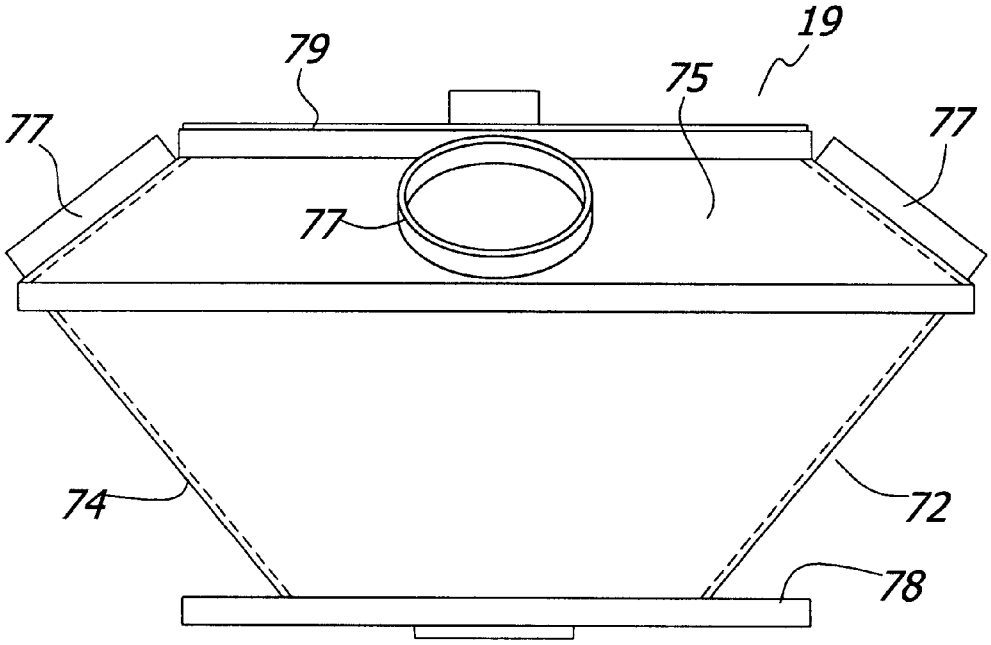
FIG. 15 is a side elevational view of the combined rotor housing and the cam cover housing further illustrating their assemblies.

The rotor assembly 12 is designed to work in conjunction with the cam assembly 14. Looking at FIGS. 10, 11, and 12, the cam assembly 14 is illustrated as including four cams 38*a*–38*d*. Each cam 38*a*–38*d* is mounted above the rotor 20 in a horizontal plane as can be viewed in FIG. 4. Each cam 38*a*–38*d* is rotatably mounted on a cam shaft 45*a*–45*d*, which is in turn mounted to a piston shaft (as described herein). Looking to FIG. 11, each cam 38*a*–38*d* includes a horizontally positioned disc 40*a*–40*d* with a single lobe 42*a*–42*d* raised from the disc 40*a*–40*d* at an angle of approximately 45 degrees from the horizontal plane. Moreover, looking back to FIG. 10, each cam 38*a*–38*d* is constructed integrally with a cam gear 44*a*–44*d* to engage a center gear 46. The four cams 38*a*–38*d* are driven by the center gear 46 that is attached to the main drive shaft 32. The center gear 46 and cam gears 44*a*–44*d* are relatively sized diametrically to produce a driver to driven ratio that is preferably 2:1. Thus, when the main drive shaft 32 has turned one revolution, each individual cam 38*a*–38*d* will have rotated one-half turn; or, when the main drive shaft 32 has completed one-half revolution (thereby generating an engine stroke cycle), each cam 38*a*–38*d* has revolved one-quarter turn.

Figure 3:
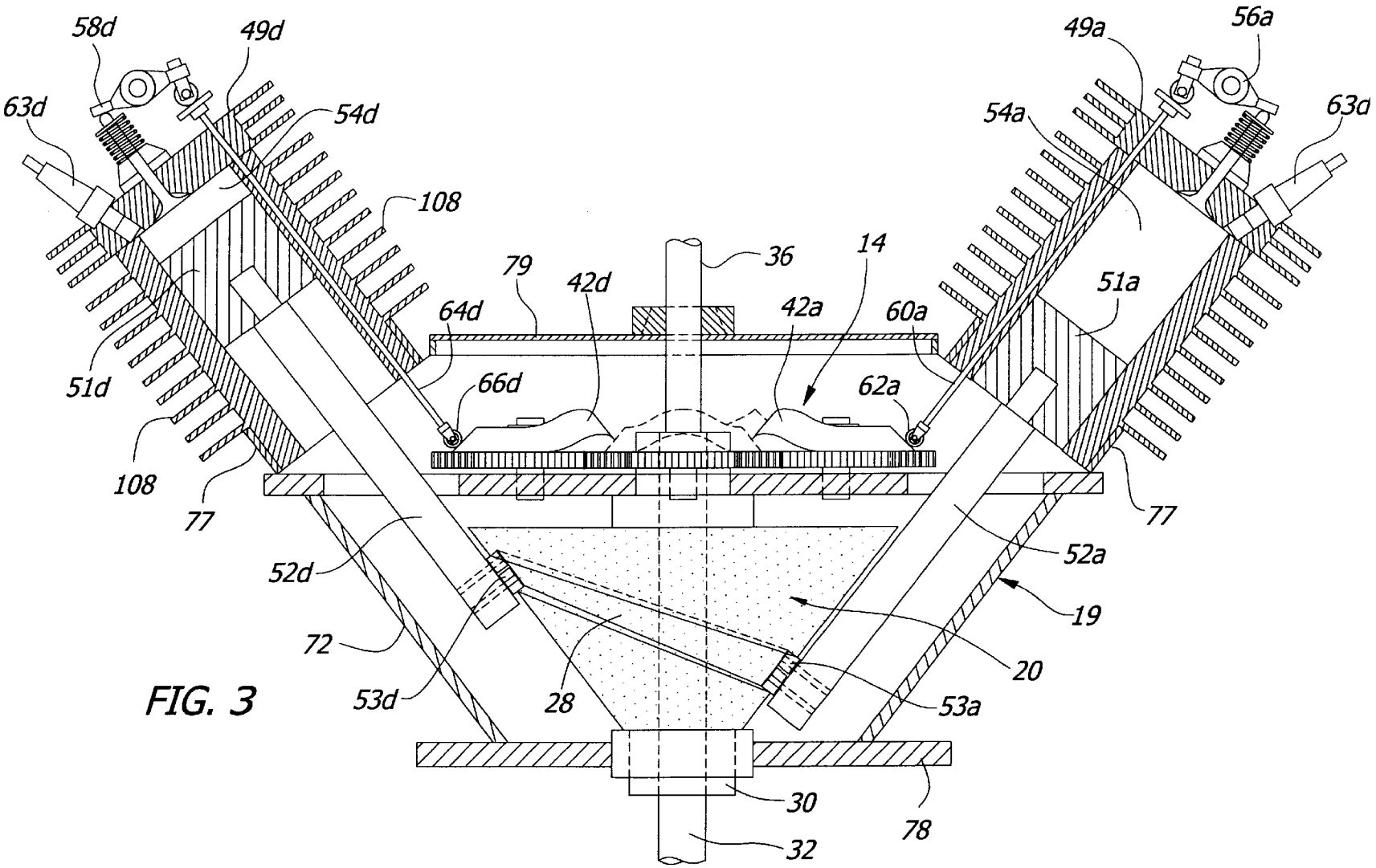
FIG. 3 is a side sectional view of two cylinders of the cylinder assembly having piston rods that engages the ellipsoidal groove of the rotor taken along lines 3—3 of FIG. 2.

Referring back to FIG. 1A, the cylinder assembly 16 is illustrated as positioned above the cam assembly 14, and the cylinder assembly 16 includes a number of conventional cylinders 50*a*–50*d* (preferably four) that correspond with the series of cams 38*a*–38*d*. Each cylinder 50*a*–50*d* is a conventional cylinder that surrounds a piston 51*a*–51*d* and that has a spark plug 63*a*–63*d* mounted in the uppermost surface, as illustrated in FIG. 3. Each piston 51*a*–51*d* is operable to move within a cylinder chamber 54*a*–54*d*, and each piston 51*a*–51*d* is connected to a piston rod 52*a*–52*d* such that the two elements move concurrently as described below. On the end of each piston rod 52*a*–52*d* opposite the piston 51*a*–51*d* is a piston follower 53*a*–53*d*, which is positioned within the elliptical groove 28 surrounding the rotor 20. Furthermore, each piston rod 52*a*–52*d* is positioned between a pair of slide-guide rails 55*a*–55*d* that are connected by a back member 82*a*–82*d*. The slide guide rails 55*a*–55*d* aid the piston rod 52*a*–52*d* in maintaining a direct path (further described herein). As a result, the rotation of the rotor 20 will cause the respective piston follower 53*a*–53*d* to follow the path provided by the ellipsoidal groove 28 and thereby cause the extension and retraction of the respective piston rod 52*a*–52*d* from within the appropriate cylinder 50*a*–50*d*. Additional disclosure of this operation is disclosed herein.

As stated above and illustrated in FIG. 1A, the valve assembly 18 is attached between the cam assembly 14 and the cylinder assembly 16. Looking to FIGS. 3 and 4, the valve assembly 18 includes a set of intake rocker valves 56*a*–56*d* and a set of exhaust rocker valves 58*a*–58*d*, with one intake rocker valve 56*a*–56*d* and one exhaust rocker valve 58*a*–58*d* being mounted to the head surface 49*a*–49*d* of each cylinder 50*a*–50*d*. Attached to each intake rocker valve 56*a*–56*d* is an intake push rod 60*a*–60*d*, and each intake push rod 60*a*–60*d* has an intake cam follower 62*a*–62*d* attached to one end to engage one of the cams 38*a*–38*d* (see FIG. 4) that is used to engage the respective disc 40*a*–40*d*. Similarly, attached to each exhaust rocker valve 58*a*–58*d* is a exhaust push rod 64*a*–64*d*, and each exhaust push rod 64*a*–64*d* has an output cam follower 66*a*–66*d* attached to one end to engage one of the cams 38*a*–38*d* that is used to engage the respective disc 40*a*–40*d*. Each intake rocker valve 56*a*–56*d* is connected to an intake conduit 57 such that the desired gas mixture will flow into the cylinder chamber 54*a*–54*d* as described herein. Moreover, each exhaust rocker valve 58*a*–58*d* is connected to an exhaust conduit 59 such that the burned gas fumes will be discharged from the cylinder chamber 54*a*–54*d* after ignition and expelled through a muffler 61 as described herein.

Figure 6:
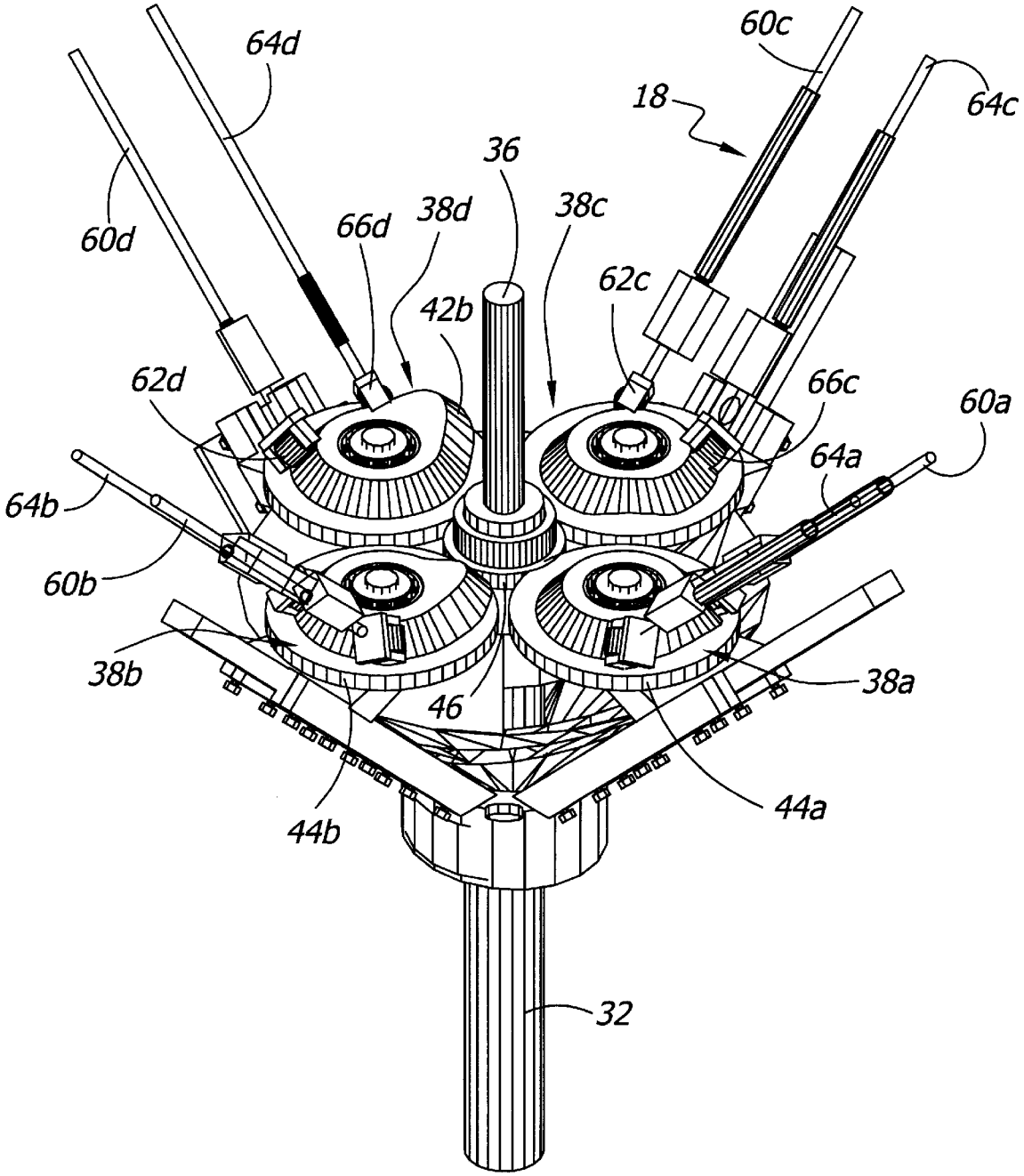
FIG. 6 is a perspective view of the cam assembly.

Looking to FIG. 3, the cam lobe 42*a*–42*d* on each cam 38*a*–38*d*, as the cam 38*a*–38*d* rotates, operates to force the intake push rod 60*a*–60*d* and the exhaust push rod 64*a*–64*d* upward when either set of rods engages the respective lobe 42*a*–42*b* (see FIG. 6). The upward motion on either the intake push rod 60*a*–60*d* or the exhaust push rod 64*a*–64*d* will operate to open the respective intake rocker valves 56*a*–56*d* or exhaust rocker valves 58*a*–58*d* on the cylinder 50*a*–50*d* associated with that cam 38*a*–38*d*, directing operation as described herein. Although the preferred embodiment of the rotary engine 10 includes four cylinders 50*a*–50*d*, there can theoretically be any number of cylinders and cams included. The purpose and operation of each rocker valve will be described herein.

The housing assembly 19 used in the present invention is most clearly illustrated in FIGS. 1A, 11, 13, 14, and 15. The housing assembly 19 includes a rotor housing 70 and an environmental casing 72. The rotor 20 is surrounded by the conical shaped housing 70, and the inner surface of the rotor housing 70 is positioned a distance from the rotor 20 to provide ample room between the rotor 20 and the rotor housing 70 for passage of lubricating oil (not illustrated) within the rotor housing 70. A series of holes (not illustrated) may also be provided in the wall of the rotor housing 70 for passage of lubricating oil from the environmental casing 72 to the piston rods 52*a*–52*d* inside the slide-guide rails 55*a*–55*d* and also to the piston follower 53*a*–53*d* positioned in the ellipsoidal groove 28.

As stated above, the rotor 20 and the rotor housing 70 are surrounded concentrically with the truncated conical outer environmental casing 72, which seals the lower part of the rotor 20 and forms a compartment for the lubricating oil reservoir and for a conventional lubricating oil circulating pump (not illustrated). The oil pump may be provided for pumping lubricating oil to the overhead valve assembly 18, and also to the cam assembly 14 if additional lubrication is required to this area. The environmental casing 72 has four access doors 74 that are bolted to the rotor house case 72. These access doors 74 provide for easy access within the environmental casing 72 for repair and maintenance. The environmental casing 72 has a circular base plate 78 to secure the environmental casing 72 to the desired apparatus.

The environmental casing 72 additionally includes an upper covering 75 that is attachable to the environmental casing 72. The upper covering 75 includes a series of cylindrical sleeves 77 for positioning and securing the cylinder assembly 16. Moreover, a lid member 79 is included that is attachable to the upper covering 75 while surrounding the shaft extension 36, and the lid member 79 is thereby able to seal and protect the area above the rotor assembly 12 from external contamination.

Additional components may also be included in the present embodiment to improve performance. For example, means for cooling the engine cylinders 50*a*–50*d* may be provided with a ducting 104 and a cooling fan 106. The ducting 104 surrounds the cylinders 50*a*–50*d*, and the cooling fan 106 is attached to the upper shaft extension 36 so that the cooling fan 106 will rotate with the rotation of the rotor 20 and provide a current of air. The cooling fan 106 is located above the cam assembly 14 such that cooling air is thereby directed over the respective cylinders 50*a*–50*d* by the ducting 104. The intake air for cooling is brought in above the cooling fan 106 and discharged laterally to the cylinders 50*a*–50*d* through centrifugal action by the blades of the cooling fan 106. Moreover, a series of cooling fins 108*a*–108*d* are also provided around each cylinder 50*a*–50*d* to allow the ambient air to additionally lower the temperature of each cylinder 50*a*–50*d*.

OPERATION OF THE ROTARY ENGINE

Looking at FIGS. 1 and 3, the rotary engine 10 depicted in this embodiment will be fitted with cylinders 50*a*–50*d* and pistons 51*a*–51*d* utilizing the prior art of a standard four cycle operating type internal combustion engine. As with a standard four-cycle engine, the pistons 51*a*–51*d* will travel through four strokes: an intake stroke, a compression stroke, a power stroke, and an exhaust stroke. In the intake stroke, an atomized fuel, conventionally gasoline (or other hydrogen-based fluid), is injected into the cylinder chamber 54*a*–54*d* while the piston 51*a*–51*d* descends to the lowermost portion of the cylinder chamber 54*a*–54*d*. The compression stroke thereby occurs wherein the piston 51*a*–51*d* is moved upward to compress the trapped fuel within the cylinder chamber 54*a*–54*d*. The spark plug 63*a*–63*d* fires to produce combustion and effect the subsequent expansion of the burning fuel, resulting in the power stroke, and causing the respective piston 51*a*–51*d* to move downward. When the piston reaches the lowest point of its travel within the cylinder 50*a*–50*d*, the power stroke will be completed, and the exhaust stroke of the piston 51*a*–51*d* will commence to discharge the burned fuel.

The rocker valves described above are important in the four cycles of the pistons 51*a*–51*d*. The fuel intake cycle begins as the piston 51*a*–51*d* descends to its lowest position within the cylinder 50*a*–50*d*, thereby drawing in the fuel vapor or gas through the intake rocker valve 56*a*–56*d*. When the piston 51*a*–51*d* has traveled to the lower limit of the intake stroke, it has drawn in a charge of mixed air and fuel by producing a negative atmospheric pressure within the cylinder 50*a*–50*d*. The piston 51*a*–51*d* begins the compression cycle as it ascends, thereby compressing the raw fuel charge within the cylinder 50*a*–50*d*. The spark plug 63*a*–63*d* fires to cause the piston 51*a*–51*d* to move to its lower most position within the cylinder chamber 54*a*–54*d*. At that point, the exhaust rocker valve 58*a*–58*d* will then begin to open, and the burned fuel will be pushed upward and out of the cylinder 50*a*–50*d* through the exhaust rocker valve 58*a*–58*d* as the piston 51*a*–51*d* rises in the cylinder 50*a*–50*d*. The exhaust stroke is completed when the piston reaches the end of its upward travel within the cylinder 50*a*–50*d*, and the cycle starts over again The exhaust and power strokes described above are important in that they determine the movement of each piston rod 52*a*–52*d* as the piston follower 53*a*–53*d* follows the path determined by the ellipsoidal groove 28. Discussing the engagement between each piston follower 53*a*–53*d* and the ellipsoidal groove 28, each piston follower 53*a*–53*d* is constructed of a lower main anti-friction roller bearing that receives the principle downward forces from the piston 51*a*–51*d* in the respective engine cylinder 50*a*–50*d* during firing power stroke. A smaller anti-friction roller bearing (not illustrated) may also be included in the piston follower 53*a*–53*d* to help to secure the piston follower 53*a*–53*d* within the ellipsoidal groove 28 and that also receives the forces caused by the upward movement of the piston rod 52*a*–52*d*.

Figure 10:
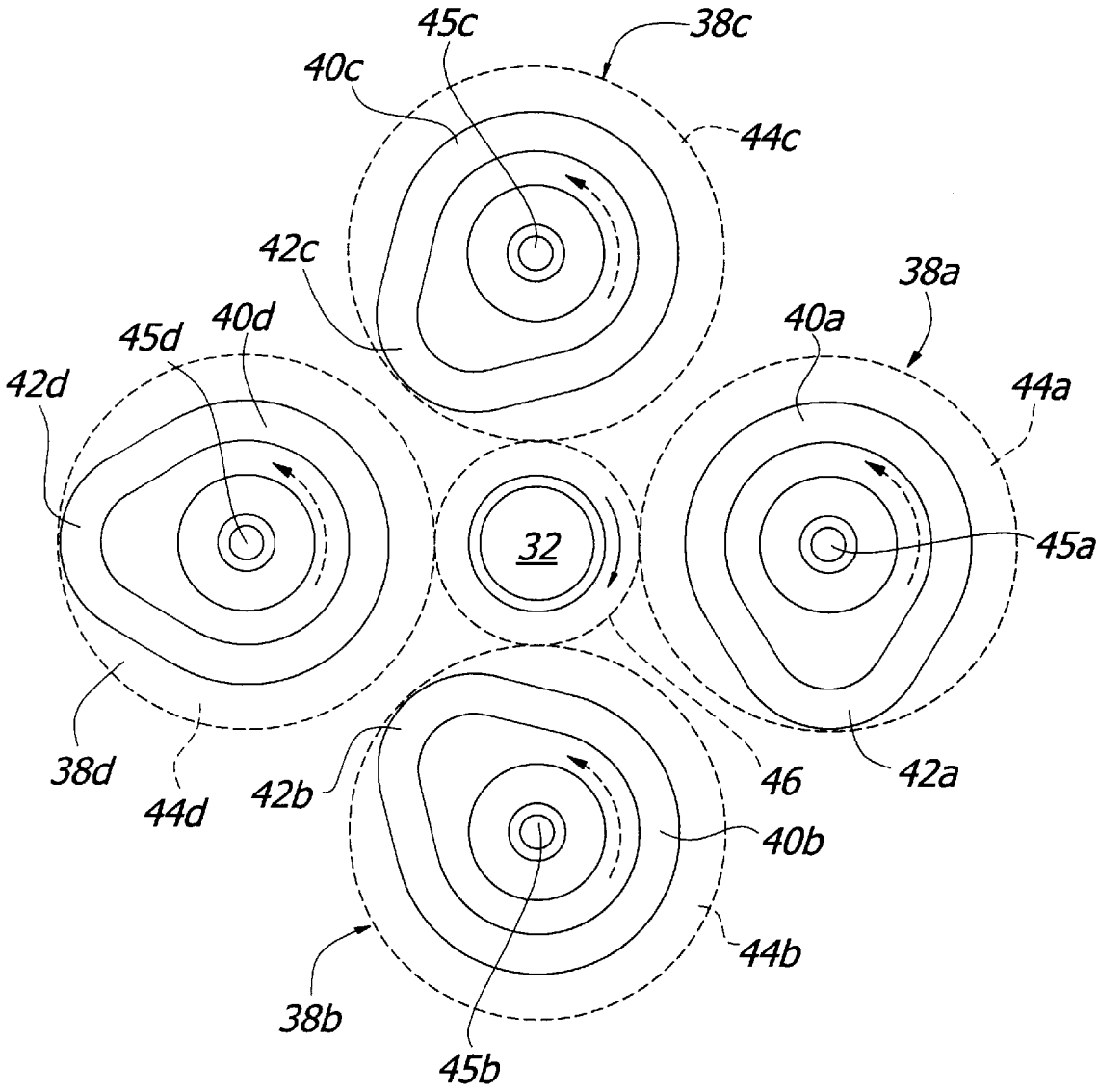
FIG. 10 is a top plan view of the laterally positioned cam assembly that actuates the intake and exhaust valves, this view illustrating the respective functions of the cams and each cam's position in the engine's four cycle stroke operating pattern.

The following sequence of operation starts with the simultaneous cam position of each cam 38*a*–38*d*, and that coincides with the starting position shown in FIG. 10. In the starting position illustrated in FIG. 10, the cams 38*a*–38*d* begin rotation operation with cylinder 50*a* firing above cam 38*a* first and cylinder 50*b* firing above cam 38*b* next, and continuing in this firing order. Beginning with cylinder 50*a* and cam 38*a*, which is rotating counter clockwise, the leading edge of the cam lobe 42*a* on cam 38 is beginning to lift the exhaust push rod 64*a* and the exhaust rocker valve 58*a* is just starting to open. At this point, the piston 51*a* is at the bottom of the cylinder 50*a*, where the piston 51*a* will begin an upward exhaust stroke. When the cam 38*a* has completed a quarter revolution (or 90 degrees), the rotor 20 will have turned one-half revolution (or 180 degrees). The cam lobe 42*a* on the cam 38*a* circumscribes 90 degrees, thus opening and closing the exhaust rocker valve 58*a* during the exhaust stroke of the piston 51*a*. At this point, the leading edge of the cam lobe 42*a* is just starting to engage the intake cam follower 62*a*, and the intake rocker valve 56*a* is beginning to open. At this point, the piston 51*a* in cylinder

50*a* is in the uppermost position within the cylinder 50*a*, and beginning a downward intake stroke. When the cam 38*a* has completed another quarter-revolution, the cam lobe 42*a* will have thus opened and closed the intake rocker valve 56*a*.

After cam 38*a* has completed the remainder of its full revolution (which is 180 degrees, or one-half turn), the subsequent compression and power strokes are performed in the other cylinders 50*b*–50*d*. Since both the intake rocker valve 56*a* and the exhaust rocker valve 58*a* remain closed during these cycles, neither valve moves, and the cam 38*a* continues to rotate through this angle without the raised lobe engaging the cam followers.

Figure 5:
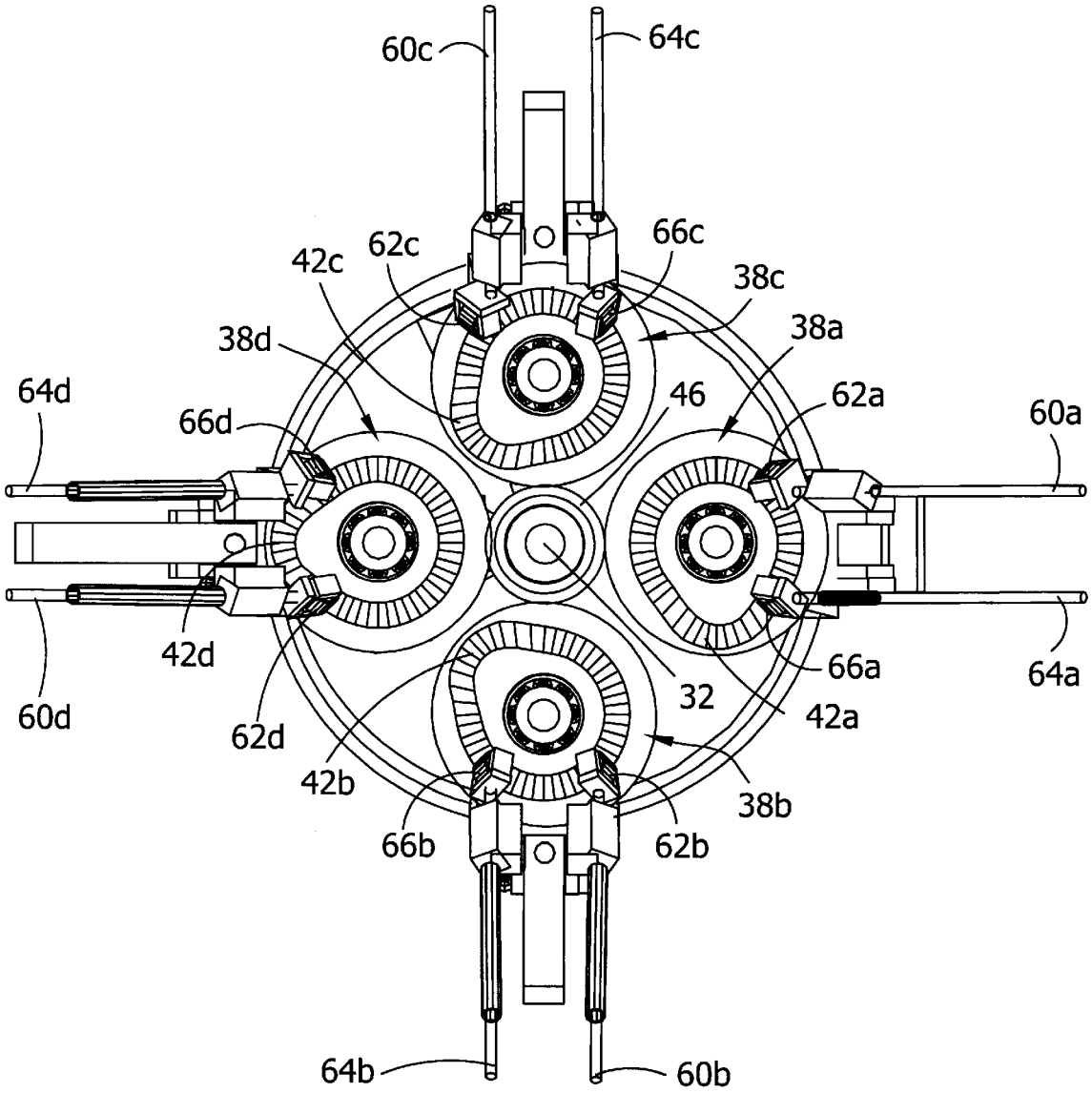
FIG. 5 is a top plan view of the rotary engine of the present invention, with the cylinder assembly removed to illustrate the cam assembly and the valve assembly.

Looking further at FIGS. 5 and 10, the simultaneous operation of the other cylinders 50*b*–50*d* and their accompanying cams 38*b*–38*d* may further be seen. For example, beginning with cylinder 50*b* and cam 38*b* (which is rotating counter clockwise), the leading edge of the cam lobe 42*b* such that the piston 51*b* in cylinder 50*b* is at a position that coincides with a position that is moving downward on the power stroke. Once the cam 38*b* has completed one-eighth revolution (or 45 degrees), the rotor 20 will have turned one-quarter revolution (or 90 degrees), and the cam lobe 42*b* will have circumscribed 45 degrees, which completes the power stroke of the piston 51*b*. At this point, the leading edge of the cam lobe 42*b* is just starting to engage the output cam follower 66*b*, and exhaust rocker valve 58*b* is just starting to open. At the same time, the piston 51*b* is at lowermost position within cylinder 50*b*, and whereby the piston 51*b* must begin its upward exhaust stroke. When the cam 38*b* has completed another quarter revolution, the cam lobe 42*b* will have opened and closed the exhaust rocker valve 66*b*, and the piston 51*b* will be positioned in the uppermost area within the cylinder 50*b*. Thereafter, the intake rocker valve 56*b* will begin to open, with the leading edge of the cam lobe 42*b* just starting to engage the intake cam follower 62*b*. After the intake cycle has finished, the compression and power strokes are subsequently performed identically to that as described above for the first cylinder 50*a*.

The operation of cylinder 50*c* and cam 38*c* in conjunction with cylinder 50*a* is as follows. The piston 51*c* in cylinder 50*c* starts half-way up the compression stroke of the cylinder 50*c*, with the leading edge of the cam lobe 42*c* at the position where it must rotate another 135 degrees counter clockwise before it will engage the output cam follower 66*c*. When the cam lobe 42*c* reaches the output cam follower 66*c*, the piston 51*c* will be at the lowermost portion within cylinder 50*c*. The exhaust cycle for cylinder 50*c* will then begin, and the subsequent cycles of operation as described above for the other cylinders will begin.

The operation of cylinder 50*d* and cam 38*d* in conjunction with cylinder 50*a* is as follows. This cam lobe 42*d* is at a position where it has just closed the exhaust rocker valve 58*d* and is just beginning to open the intake rocker valve 56*d*. Subsequently, as the cam lobe 42*d* rotates another 45 degrees, it will have opened and closed the intake rocker valve 56*d*, and must then rotate another 180 degrees (during the compression and power cycles) before engaging the exhaust rocker valve 58*d*. This cylinder 50*d* and cam 38*d* thereafter operates identically to the previous description of the operation of cylinder 50*a*.

To prolong the life of the ellipsoidal groove 28 in the rotor 20, it is preferred that the ellipsoidal groove 28 and roller 92*a*–92*d* dimensions be sufficiently large and that the ellipsoidal groove 28 be constructed to be surrounded by hardened steel and/or a steel alloy in order to provide sufficient wear resistance against the high point-contact bearing stresses caused by the piston follower roller 92*a*–92*d*.

Preferably, there are two or more power producing cylinders 50*a*–50*d* to provide a benefit in the nature of mechanical dynamic balancing. These cylinders 50*a*–50*d* are mounted concentrically around the rotor 20. Looking at a side view of the rotor 20, the cylinders 50*a*–50*d* will be set at an angle of approximately forty-five degrees from the central axis of the main drive shaft 32. As with conventional engines, a plurality of cylinders 50*a*–50*d* may be used without affecting the basic inventive concepts of the invention. The number of cylinders 50*a*–50*d* used is limited only by the diameter of the rotor in proportion to the size ratio of the respective cylinders. However, for practical purposes, a maximum of eight cylinders is anticipated. This embodiment depicts an engine with four (4) cylinders, but it is realized that other numbers of cylinders may be used.

Because of this angled position of each cylinder 50*a*–50*d*, wear of the piston 51*a*–51*d* and the wall surrounding the cylindrical cavity 54*a*–54*d* will be reduced as compared with conventional engines. This reduction in wear is the result of the elimination of the piston "side slap" force, which is caused by the hinged connecting rod connection to the piston and is always present in conventional reciprocating engine designs. The reduction of wear will prolong the life of cylinders 50*a*–50*d* and pistons 51*a*–51*d*, and increasing the lifetime of the engine. Moreover, the pistons 51*a*–51*d* are more positively guided in the cylinders 50*a*–50*d* of this invention than in conventional engines, which also reduces lateral forces of the piston 51*a*–51*d* on the walls of the cylinders 50*a*–50*d*, since these forces will be absorbed within the walls of the slide guide rails 55*a*–55*d*.

Additional benefits of the present design include that engine vibration of the rotary engine 10 is also lessened by the inherent balancing of the geometric area of the rotating mass of the rotor 20. Moreover, the present design is less complex than compared to a conventional engine having a crankshaft, which provides increased efficiency in production and manufacturing operations as compared to conventional engine designs.

Thus, although there have been described particular embodiments of the present invention of a new and useful ROTARY ENGINE HAVING A CONICAL ROTOR, it is not intended that such references be construed as limitations upon the scope of this invention except as set forth in the following claims.

What claimed is:

1. rotary engine for producing rotational mechanical energy, said rotary engine comprising:

a main drive shaft;

a substantially conical rotor mounted on said main drive shaft, said rotor having an upper surface and a lower surface, said upper surface being connected to said lower surface by an outer surface upon which a groove is engraved;

a cylinder having a piston, said cylinder positioned parallel to said outer surface of said rotor;

a piston rod having a first and second end, said first end connected to said piston;

a piston follower connected to said second end of said piston rod, said piston follower positioned within said groove;

wherein said piston follower travels the path of said groove in said rotor by rolling within said groove of said rotor.

2. The rotary engine described in claim 1 wherein said rotor is frustoconical.

3. The rotary engine described in claim 1 wherein said the path of said groove surrounding said rotor is elliptical.

4. The rotary engine described in claim 1 further comprising a valve assembly attached to said cylinder to control the input and output of a fuel into said cylinder; and a cam assembly connected to said main drive shaft;

wherein said valve assembly contacts said cam assembly such that said cam assembly controls operation of said valve assembly.

5. The rotary engine described in claim 4 wherein said cam assembly comprises at least one cam having:

a disc;

a lobe on said disc;

a center gear extending around said main drive shaft;

a cam gear attached to said disc, said cam gear engaging said center gear such that said center gear controls rotation of said disc.

6. The rotary engine described in claim 5 wherein said valve assembly comprises:

an intake valve attached to an intake push rod, said intake push rod further being connected to an intake disc follower; and an exhaust valve attached to an exhaust push rod, said exhaust push rod further being connected to an output disc follower;

wherein said intake disc follower and said output disc follower engage said disc such that said intake disc follower elevates upon engaging said lobe to open said intake valve and said output disc follower elevates upon engaging said lobe to open said exhaust valve.

7. The rotary engine described in claim 4 further comprising a housing assembly surrounding said rotor and said cam assembly.

8. The rotary engine described in claim 7 wherein said housing includes an environmental casing and a lid member.

9. The rotary engine described in claim 1 further comprising:

an extension shaft attached to said main drive shaft;

a ducting substantially encasing said cylinder, and a fan attached to said extension shaft to govern the temperature of the cylinder.

10. The rotary engine described in claim 1 further comprising:

an extension shaft attached to said main drive shaft;

a ducting substantially encasing said cylinder; and a cooling fan attached to said extension shaft to reduce the ambient temperature of said rotary engine.

11. A method of generating mechanical energy with a rotary engine comprising the following steps:

a. providing a substantially conical rotor attached to a main drive shaft, said rotor having an upper surface and a lower surface, said upper surface joined to said lower surface by an outer surface, said conical rotor having a groove engraved around said outer surface;

b. providing at least one cylinder substantially parallel to said outer surface of said rotor, said cylinder including a cylinder chamber substantially surrounding a piston, said piston attached to a proximal end of a piston rod, and wherein a piston follower is attached to a distal end of said piston rod, said piston follower engaging said groove;

c. plunging said piston within said cylinder chamber downward such that said piston rod moves in an inclined path; and d. rotating said rotor according to the force applied by the piston follower within said groove as the piston moves within said cylinder chamber.

12. The method as descried in claim 11 further comprises the steps of:

e. providing a cam comprising a cam disc having a cam lobe mounted on a cam gear, said cam gear rotatably engaging a center gear surrounding said main drive shaft;

f. providing an intake valve mounted on said cylinder, said intake valve being connected to a first end of an intake push rod;

g. engaging said cam disc with a second end of said intake push rod;

h. rotating said cam disc forces such that said intake valve opens when said second end of said intake push rod engages said cam lobe;

i. providing fuel in said cylinder chamber through said intake valve;

j. igniting said fuel in said cylinder with a spark plug mounted to said cylinder, said ignition creating burned fuel gasses within said cylinder;

k. providing an exhaust valve mounted on said cylinder, said exhaust valve being connected to a first end of an exhaust push rod;

l. engaging said cam disc with a second end of said exhaust push rod such that the rotation of said cam disc forces said exhaust valve to open when said second end of said exhaust push rod engages said cam lobe to empty said cylinder of burned fuel gasses.

13. A rotary engine comprising:

a main drive shaft;

a substantially frustoconical rotor mounted on said main drive shaft, said rotor having an upper surface and a lower surface, said upper surface being joined to said lower surface by an outer surface;

at least one cylinder;

a piston positioned in each cylinder, said piston connected to a piston rod;

a piston follower attached to said piston rod, said piston follower positioned in said groove;

wherein each piston follower travels the path prescribed by said groove to induce the rotation of said rotor.

14. The rotary engine described in claim 13 wherein said groove surrounding said rotor is elliptical.

15. The rotary engine described in claim 13 further comprising:

a valve assembly attached to each said cylinder to allow fuel to enter and exit said cylinder; and a cam assembly attached to said rotor;

wherein said valve assembly contacts said cam assembly such that said cam assembly controls the operation of said valve assembly.

16. The rotary engine described in claim 15 wherein said cam assembly comprises:

a disc;

a lobe positioned on said disc;

a center gear surrounding said main drive shaft;

a cam gear surrounding said disc, said cam gear engaging said center gear such that said center gear controls rotation of said disc.

17. The rotary engine described in claim 16 wherein said valve assembly comprises:

an intake valve attached between an intake push rod and said cylinder, said intake push rod further being connected to an intake disc follower; and an exhaust valve attached between an exhaust push rod and said cylinder, said exhaust push rod further being connected to an output disc follower;

wherein said intake disc follower and said output disc follower engage said disc such that said intake disc follower elevates upon engaging said lobe to open said intake valve and said output disc follower elevates upon engaging said lobe to open said exhaust valve.

18. The rotary engine described in claim 17 wherein said intake valve and said exhaust valve are each rocker valves.

19. The rotary engine described in claim 15 further comprising a housing assembly surrounding said rotor and said cam assembly.

20. The rotary engine described in claim 19 wherein said housing includes an environmental casing and a lid member.

* * * * *